United States Patent [19]

Conn

[11] 4,265,363

[45] May 5, 1981

[54] CONTAINER WITH DRINKING TUBE

[76] Inventor: John L. Conn, P.O. Box 4501 - Sta. B, Spartanburg, S.C. 29303

[21] Appl. No.: 97,828

[22] Filed: Nov. 26, 1979

[51] Int. Cl.[3] ..... B65D 25/38

[52] U.S. Cl. ..... 215/229; 215/1 A

[58] Field of Search ..... 215/229, 1 A, 356, 314; 220/90.2

[56] References Cited

U.S. PATENT DOCUMENTS

| | | | |
|---|---|---|---|
| 1,415,908 | 5/1922 | Tofting | 215/356 X |
| 1,962,883 | 6/1934 | Tate | 215/1 A X |
| 2,820,671 | 1/1958 | McFarland | 215/356 X |
| 3,291,331 | 12/1966 | Grisham | 215/1 A |
| 3,568,870 | 3/1971 | Elston | 215/229 |

FOREIGN PATENT DOCUMENTS

| | | | |
|---|---|---|---|
| 359051 | 1/1962 | Switzerland | 215/1 A |

*Primary Examiner*—Donald F. Norton

[57] ABSTRACT

In combination, the Construction of a hollow container having cylindrically shaped side wall, a bottom, and a top internally threaded opening, a solid externally threaded closure cap having a top surface centrally mounted raised finger turning area and a tube opening located through the top, outer threaded perimeter area that extends downwardly and diagonally through said cap's bottom surface at the central area of said cap wherein said cap's hole area will house the top end area of a flexible drinking tube wherein said bent tensed tube will spring-out of said container and cap hole for use when said cap is partly removed.

2 Claims, 4 Drawing Figures

CONTAINER WITH DRINKING TUBE

BACKGROUND OF THE INVENTION

Field of the Invention

This invention relates to the common beverage container and more particularly it relates to a hollow container that has a top internally threaded opening and a solid connecting externally threaded closure cap wherein said cap having a diagonal tube opening through said cap's top, upper threaded perimeter area wherein said tube opening is extended downwardly and diagonally to the bottom central cap area so to house the top end area of a drinking tube.

Container with drinking tubes or straws have been known for years but the construction of a container having a closure cap wherein said cap will house a bent tensed drinking tube whereby said drinking tube will partly self eject through a hole located through said cap's top threaded perimeter area is new and novel.

The construction of a hollow container with a solid closure cap and a drinking tube wherein said closure cap will seal said container, and also seal said drinking tube inside said container, and also seal said tube's opening.

This invention is preferably constructed from molded plastic or the like.

BRIEF SUMMARY OF THE INVENTION

It is therefore a primary object of this invention to provide a container with closure cap and drinking tube wherein the top, outer threaded perimeter area of said closure cap has constructed a tube hole or opening through said cap's top, upper threaded perimeter area wherein said tube opening is extended downwardly and diagonally to the bottom central cap area wherein said drinking tube's top end area will be housed sanitarily inside said cap's opening when said container is sealed wherein said drinking tube will self eject partly or spring-out of said container and cap opening when said closure cap is partly removed from said container to be used as an operative drinking tube.

It is another object of the present invention to provide a container and closure cap with drinking tube wherein said flexible drinking tube is sealed inside said container and retained in a bent tensed position when said container is closed whereby the partly removing of said cap will allow said drinking tube to spring-out of said container and cap hole so to display an operative drinking tube ready for use.

It is another object to provide a container with cap and drinking tube that is easy to manufacture and one that is simple and easy to use and one that is well adapted for purpose intended.

BRIEF DESCRIPTION OF THE INVENTION

The accompanying drawings, which are incorporated in and constitute a part of this specification illustrate one design of the invention and, therefore with a description serve to explain the principles of the invention.

DETAILED DESCRIPTION OF THE INVENTION

Figure 2:
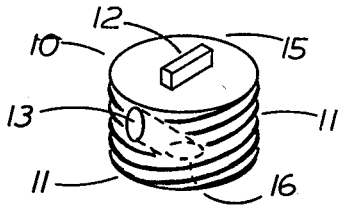
FIG. 2 is a view of the externally threaded closure cap having the top mounted finger turning area and the diagonal tube opening.
Figure 3:
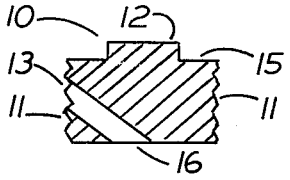
FIG. 3 is a central cut away view of the closure cap.
Figure 4:
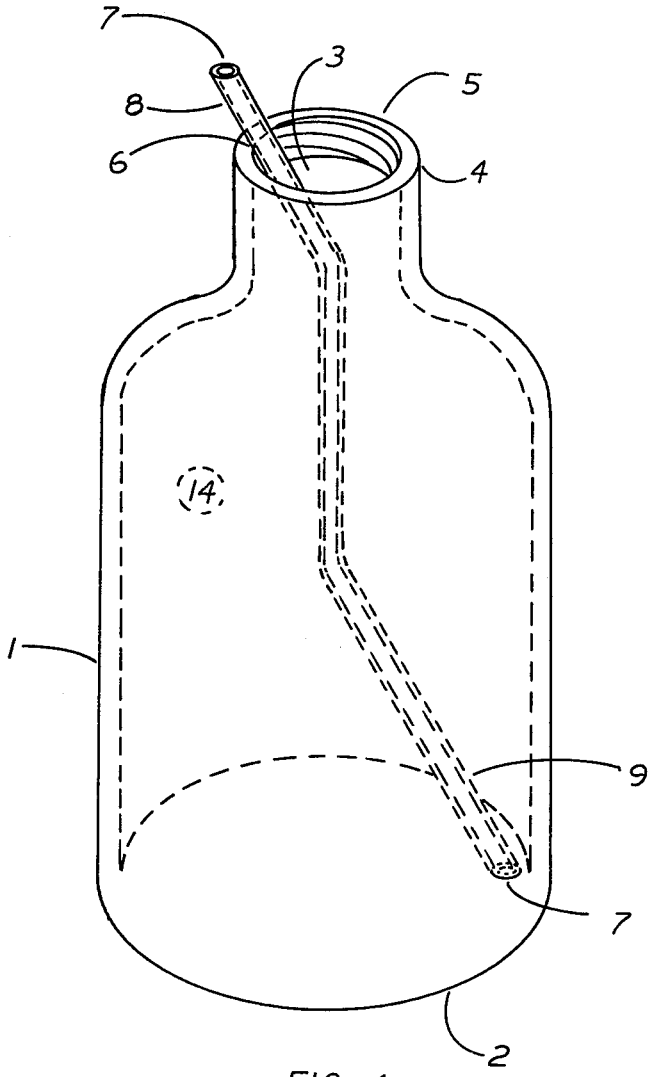
FIG. 4 is a view of the internally threaded container showing the drinking tube in the bent tensed position without the closure cap.

Referring now to the drawings and more particular to FIG. 4 at this time which represents a hollow container (1) having cylindrically shaped side wall (1), a bottom (2) and a top internally threaded (5) opening (3) with rim area (4) that is common to the beverage containers wherein the construction of a solid closure cap (10) having external threads (11) and having a centrally located top surface (15) mounted raised finger turning area (12) wherein said closure cap (10) has constructed through the upper threaded area (11) a tube opening (13) that is larger in circumference than said tube (6) wherein said cap's tube opening (13) extends downwardly and diagonally from the top threaded perimeter area to the bottom central cap area (16).

Figure 1:
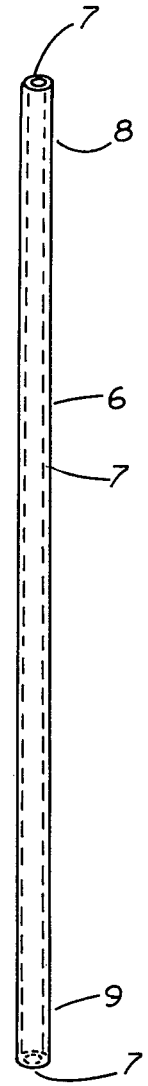
FIG. 1 is a view of the flexible drinking tube with opening.

The drinking tube (6) with opening (7) as shown in FIG. 1 is smaller in circumference than the circumference of the cap's tube opening (13) so that the tube (6) is permitted to freely move through the cap's opening (13) that permits said drinking tube (6) to self eject when the closure cap (10) is partly removed from the container (1) due to the tube (6) being made of a flexible material and having been housed inside (14) the container (1) in a bent tensed position.

To fill and seal the container will be as follows:

The container (1) is filled with liquid contents (14) and then the closure cap (10) is connected to the container (1) to a point where the cap's tube opening (13) is positioned directly above the container's rim (4) area and then the drinking tube (6) which is longer in length than the complete inside diagonal height of said container (1) is placed inside the container (1) through the cap's opening (13) so to rest the lower end (9) of the tube (6) against the inside container's bottom (2) wall area (1). The tube (6) being of flexible material is pressed inside the container so to store the drinking tube (6) in a bent tensed position inside said container wherein said closure cap (10) is then completely sealed to the container (1) wherein said drinking tube (6) now being sealed inside said container (1) wherein the top end (8) of the drinking tube (6) will rest against the top inside area of the internally threaded container's opening (5).

When it is desired to open the container (1) it will be accomplished by removing the closure cap (10) partly so that the cap's hole (13) will clear the container's rim area (4) wherein said drinking tube (6) will partly self-eject so to be used in the siphoning method. If it is desired to drink the contents it may be done by completely removing the closure cap (10) and drinking tube (6).

The lead of the connecting threads of the container (1) and cap (10) are arranged so that approximately one-half revolution of said cap will seal the cap's tube hole (13) and aline said cap's top surface (15) with the rim area (4) of said container.

Not shown in drawings and specifications but a flanged area may be constructed on the drinking tube's (6) lower end (9) and thus construct a nozzle.

While various changes may be made in the general design it is hoped that such changes will not alter the spirit and score of the present invention as is defined by the claims.

What is claimed:

1. In combination, a hollow container having a cylindrically shaped side wall, a bottom and an internally threaded neck having an opening and a rim area and a solid externally threaded closure cap for threaded engagement with said internally threaded neck, said cap having a centrally mounted, raised, finger grip on the top surface of said cap, said cap having an opening for receiving a flexible drinking tube, said opening extending through the top outer threaded perimeter of said cap and extending downwardly and diagonally through the bottom central area of said cap.

2. The combination of claim 1 and further comprising a flexible drinking tube having a smaller circumference than said cap opening and having a longer length than the internal diagonal height of said container.

* * * * *